US009570262B1

(12) United States Patent
Thomas et al.

(10) Patent No.: US 9,570,262 B1
(45) Date of Patent: Feb. 14, 2017

(54) APPARATUS AND METHODS FOR A CIRCUIT BREAKER POSITIVE-OFF STOP FEATURE

(71) Applicant: Siemens Aktiengesellschaft, München (DE)

(72) Inventors: Stephen Scott Thomas, Atlanta, GA (US); Xinhua Chen, Atlanta, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 14/867,094

(22) Filed: Sep. 28, 2015

(51) Int. Cl.
*H01H 9/28* (2006.01)
*H01H 71/52* (2006.01)
*H01H 69/00* (2006.01)

(52) U.S. Cl.
CPC ..... *H01H 71/521* (2013.01); *H01H 69/00* (2013.01); *H01H 2205/002* (2013.01); *H01H 2221/016* (2013.01)

(58) Field of Classification Search
CPC H01H 71/521; H01H 69/00; H01H 2205/002; H01H 221/016
USPC ..... 200/43.16, 318, 187, 189, 244, 318.1, 200/320, 325, 401; 335/23–25, 335/166–168, 170–175; 29/622
See application file for complete search history.

(56) References Cited

U.S. PATENT DOCUMENTS

| | | | | |
|---|---|---|---|---|
| 4,165,453 | A | 8/1979 | Hennemann | |
| 4,307,359 | A * | 12/1981 | Schultz | H01H 9/0264 335/191 |
| 5,270,564 | A | 12/1993 | Parks et al. | |
| 5,449,871 | A | 9/1995 | Batteux et al. | |
| 5,543,595 | A | 8/1996 | Mader et al. | |
| 5,898,146 | A * | 4/1999 | Beck | H01H 77/104 200/244 |
| 8,749,326 | B2 | 6/2014 | Yang | |
| 8,859,919 | B2 * | 10/2014 | Chen | H01H 71/505 200/318 |
| 2009/0189719 | A1 | 7/2009 | Yang | |
| 2012/0085627 | A1 | 4/2012 | Yang | |
| 2014/0251769 | A1 | 9/2014 | Chen | |

FOREIGN PATENT DOCUMENTS

EP 0325725 B1 1/1995

* cited by examiner

*Primary Examiner* — Edwin A. Leon

(57) ABSTRACT

A circuit breaker having a positive-off stop feature includes an operating lever rotatably coupled to a side frame, a tension lever coupled to the side frame, and an upper toggle linkage and a stop link each rotatably coupled to the tension lever. The upper toggle linkage may be configured to rotate the stop link. The operating lever may be configured to move rotatably to and from an ON position and an OFF position provided the main contacts of the circuit breaker are not welded or otherwise stuck together. Should the main contacts become welded or otherwise stuck together, the upper toggle linkage may be configured to rotate the stop link to a position wherein the stop link may be configured to prevent the operating lever from moving into the OFF position. Methods of assembling a circuit breaker positive-off stop feature are also provided, as are other aspects.

20 Claims, 8 Drawing Sheets

APPARATUS AND METHODS FOR A CIRCUIT BREAKER POSITIVE-OFF STOP FEATURE

FIELD

The invention relates generally to circuit breakers and, more particularly, to circuit breakers having a positive-off stop feature that prevents the operating handle from moving into an OFF position should the main contacts of the circuit breaker become welded or otherwise stuck together.

BACKGROUND

Circuit breakers may be used to protect an electrical circuit coupled to an electrical power supply. Circuit breakers may automatically interrupt power to the electrical circuit when, e.g., an overcurrent (i.e., excessive current) is detected. An overcurrent may result from, e.g., a short circuit, an overload, or a ground fault. The automatic interruption of power may prevent electrical shock hazards and/or damage to electrical equipment and surrounding infrastructure. Circuit breakers may also be manually operated to connect and disconnect power to an electrical circuit by moving an operating handle mounted on the housing of the circuit breaker. The operating handle typically has three positions: ON, OFF, and TRIPPED. The ON position typically indicates that the main contacts of the circuit breaker are closed (i.e., in contact with each other), which connects power to the electrical circuit. The OFF position typically indicates that the main contacts have been opened manually via the operating handle to disconnect power from the electrical circuit. And the TRIPPED position typically indicates that the main contacts have been opened automatically by a tripping mechanism of the circuit breaker in response to detection of an overcurrent to also disconnect power from the electrical circuit.

Under some abnormal operating conditions, the main contacts may become welded, fused, or otherwise stuck together. For example, a high in-rush current and/or a partial failure and/or delay of the tripping mechanism may cause the main contacts to overheat to a point where they may fuse or weld together upon contact. Such a condition may go undetected. Consequently, a subsequent movement of the operating handle into the OFF position, which may not result in the stuck main contacts opening, may erroneously and dangerously indicate that power is disconnected from an electrical circuit when, in fact, power remains connected.

Accordingly, there is a need for apparatus and methods that prevent an operating handle of a circuit breaker from being moved into an OFF position after the main contacts of the circuit breaker have become stuck together. Such apparatus and methods may be referred to as "positive-off stop" apparatus and methods.

SUMMARY

According to one aspect, a circuit breaker is provided. The circuit breaker includes a side frame; an operating lever rotatably mounted to the side frame and configured to move rotatably to and from an ON position and an OFF position provided a pair of main contacts of the circuit breaker is not stuck together; a tension lever coupled to the side frame; an upper toggle linkage having a first end rotatably coupled to the tension lever; and a stop link rotatably coupled to the tension lever and configured to be rotated by the upper toggle linkage; wherein the upper toggle linkage is configured to rotate the stop link to a first position provided that the main contacts are not stuck to each other and is configured to rotate the stop link to a second position in response to the main contacts being stuck to each other, the stop link in the second position configured to engage the operating lever as the operating lever is moved rotatably towards the OFF position.

According to another aspect, a method is provided of preventing a circuit breaker from being set in an OFF position in response to a pair of main contacts of the circuit breaker being stuck together. The circuit breaker includes an upper toggle linkage, a tension lever, a stop link, and an operating lever. The method includes rotating the upper toggle linkage about a first end of the upper toggle linkage to a first location in response to the pair of main contacts not being stuck together, the upper toggle linkage rotatably coupled to the tension lever; rotating the stop link rotatably coupled to the tension lever to a first position in response to the upper toggle linkage rotating to the first location; rotating the upper toggle linkage about the first end to a second location in response to the pair of main contacts being stuck together; rotating the stop link rotatably to a second position in response to the upper toggle linkage rotating to the second location; and engaging the operating lever at about 7 to 10 degrees away from the OFF position as the operating lever is being moved towards the OFF position in response to the stop link rotating to the second position.

According to a further aspect, a method of assembling a circuit breaker positive-off stop feature is provided. The method includes coupling rotatably an operating lever to a first side frame; providing a U-shaped tension lever having a first recessed area on a first side of the tension lever; coupling the tension lever to the first side frame; coupling rotatably a first end of a first upper toggle linkage to the first side of the tension lever; and coupling rotatably a first stop link to the first side of the tension lever in the first recessed area; wherein the first stop link is configured to be rotated by the first upper toggle linkage into a first position that does not engage the operating lever as the operating lever moves rotatably to and from an ON position and an OFF position; and the first stop link is configured to be rotated by the first upper toggle linkage into a second position that stops the operating lever from moving rotatably into the OFF position at about 7 to 10 degrees away from the OFF position.

Still other aspects, features, and advantages of the invention may be readily apparent from the following detailed description wherein a number of example embodiments and implementations are described and illustrated, including the best mode contemplated for carrying out the invention. The invention may also include other and different embodiments, and its several details may be modified in various respects, all without departing from the scope of the invention. Accordingly, the drawings and descriptions are to be regarded as illustrative in nature, and not as restrictive. The invention covers all modifications, equivalents, and alternatives of the aspects disclosed herein.

BRIEF DESCRIPTION OF DRAWINGS

Persons skilled in the art will understand that the drawings, described below, are for illustrative purposes only. The drawings are not necessarily drawn to scale and are not intended to limit the scope of this disclosure in any way.

DETAILED DESCRIPTION

Figure 1:
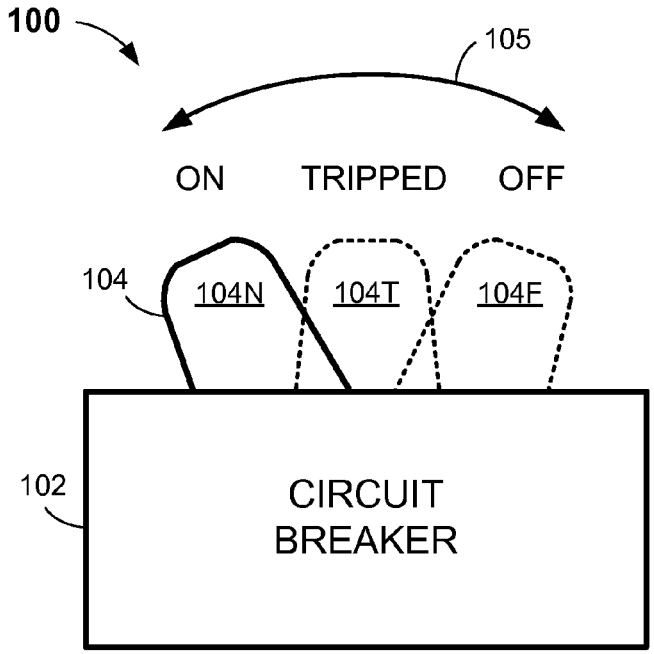
FIG. 1 PRIOR ART
FIG. 1 illustrates a block diagram of a circuit breaker and its operating handle positions.

Reference will now be made in detail to the example embodiments of this disclosure, which are illustrated in the accompanying drawings. Wherever possible, the same reference numbers will be used throughout the drawings to refer to the same or like parts.

In one aspect, a circuit breaker includes a positive-off stop feature that requires little to no extra space in an assembly of operating components of the circuit breaker. The assembly of operating components incorporating the positive-off stop feature may be enclosed in a housing of the circuit breaker and may be coupled to interact with other components of the circuit breaker, such as, e.g., an operating handle, a pair of main contacts and associated parts and/or linkages, and a tripping mechanism. The assembly of operating components may cause the main contacts to open and close via a user moving the operating handle under normal conditions (e.g., the main contacts not being welded or otherwise stuck together). The assembly of operating components may also cause the main contacts to open in response to an overcurrent detected by the tripping mechanism. Should the main contacts of the circuit breaker become welded or otherwise stuck together as a result of an abnormal occurrence, the positive-off stop feature incorporated in the assembly of operating components is configured to prevent the operating handle from being moved into the OFF position. The positive off stop feature may thus give a user a visual and/or tactile indication via the prevented movement of the operating handle into the OFF position that power has not been disconnected and/or that something is wrong. This may avoid the dangerous situation in which an operating handle set in the OFF position may erroneously indicate that power has been disconnected when, in fact, it has not.

In some embodiments, a circuit breaker having the positive off stop feature in accordance with one or more embodiments may include an operating lever, a side frame, a tension lever, an upper toggle linkage, and a stop link. An operating handle of the circuit breaker may be coupled to the operating lever, which may be rotatably mounted to the side frame. The tension lever, which in some embodiments may be U-shaped, may be coupled to the side frame. The upper toggle linkage and the stop link may both be coupled to a same side of the tension lever and, in particular, to a same inside surface of a side of the tension lever. In some embodiments, the stop link may be coupled to the tension lever in a recessed area on a side of the tension lever, which may save more space within the circuit breaker. In response to the main contacts of the circuit breaker becoming welded or otherwise stuck together, the upper toggle linkage may be configured to rotate the stop link into a position at which the stop link may be configured to engage the operating lever as it is rotatably moved towards the OFF position. In some embodiments, the stop link may be configured to stop the rotational movement of the operating lever towards the OFF position at about 7 to 10 degrees away from the OFF position.

In other aspects, methods of preventing a circuit breaker from being set in an OFF position in response to a pair of main contacts of the circuit breaker being welded or otherwise stuck together, and methods of assembling a circuit breaker positive-off stop feature, are provided, as will be explained in greater detail below in connection with FIGS. 1-8.

Figure 2A:
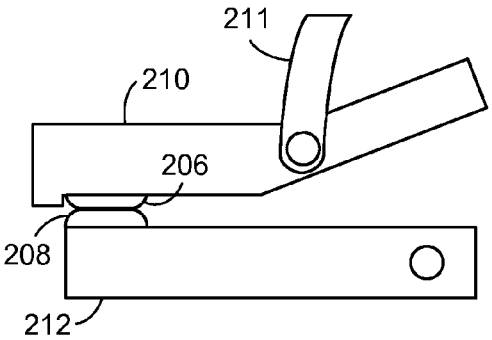
FIG. 2A PRIOR ART
FIGS. 2A and 2B illustrate simplified side views of a pair of main contacts of a circuit breaker.
Figure 2B:
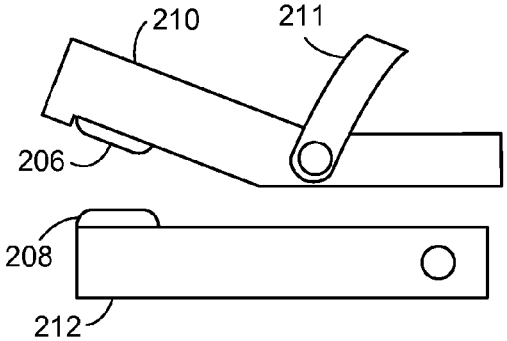
FIG. 2B PRIOR ART

FIGS. 1, 2A, and 2B illustrate a normal operation of a circuit breaker. FIG. 1 illustrates a circuit breaker 100 and three operating handle positions thereof: ON, TRIPPED, and OFF. Circuit breaker 100 is typically coupled between a power source and an electrical circuit to be protected by circuit breaker 100 (neither the power source nor the electrical circuit is shown in FIG. 1). The electrical circuit may include one or more electrical loads (e.g., devices or appliances that operate with electrical power). Circuit breaker 100 may include a housing 102, which may be, e.g., an insulated molded case made of a thermal set plastic, such as a glass polymer, and may be assembled from two or more parts. Housing 102 may enclose the various mechanical and electrical components of the circuit breaker (several of which are described herein). Circuit breaker 100 may also include an operating handle 104 mounted on housing 102 and configured to move rotatably as shown via double-headed arrow 105. Operating handle 104 is shown in FIG. 1 in an ON position 104N. This may indicate that power is connected from the power source through circuit breaker 100 to the electrical circuit. Operating handle 104 may be rotatably moved automatically to a TRIPPED position 104T (shown in phantom) in response to detection of an overcurrent by a tripping mechanism of the circuit breaker. Operating handle 104 may also be rotatably moved manually by a user to an OFF position 104F (shown also in phantom). Both the TRIPPED and OFF positions normally indicate that power is disconnected from the electrical circuit.

FIGS. 2A and 2B illustrate a pair of main contacts 206 and 208 that may be enclosed in housing 102 of circuit breaker 100. Main contact 206 may be a movable contact attached to a movable contact arm 210, and main contact 208 may be a stationary contact attached to a stationary contact arm 212. Movable contact arm 210 may be coupled to a contact linkage 211, which may be part of a mechanism that controls the opening and closing of main contacts 206 and 208. Operating handle 104 set in ON position 104N may indicate that main contacts 206 and 208 are closed, as shown in FIG. 2A, allowing power to flow from the power source through circuit breaker 100 to the electrical circuit. Movement of operating handle 104 either automatically into TRIPPED position 104T, or manually into OFF position 104F, normally indicates that movable contact arm 210 has moved away from stationary contact arm 212, opening (i.e., physically and electrically separating) main contacts 206 and 208, as shown in FIG. 2B. These automatic and manual movements normally result in power being disconnected from the power source to the electrical circuit. However, as described above, should main contacts 206 and 208 become welded or otherwise stuck together, manual movement of operating handle 104 into OFF position 104F should not be permitted.

Figure 3A:
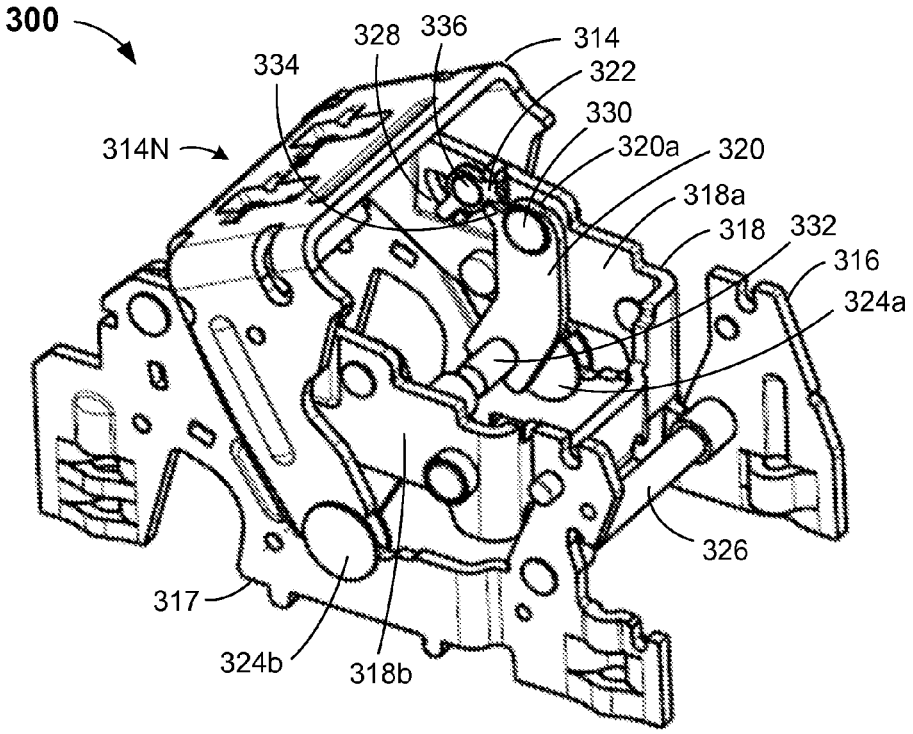
FIGS. 3A and 3B respectively illustrate perspective and side views of an assembly of operating components of a circuit breaker in an ON position according to embodiments.
Figure 3B:
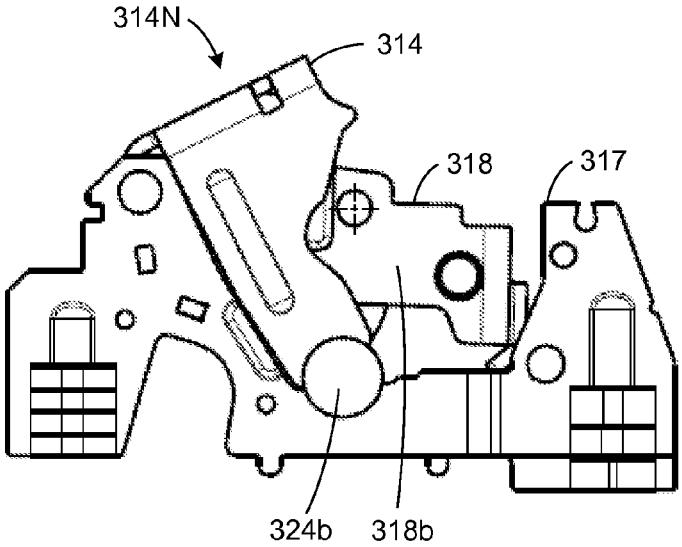
Figure 4A:
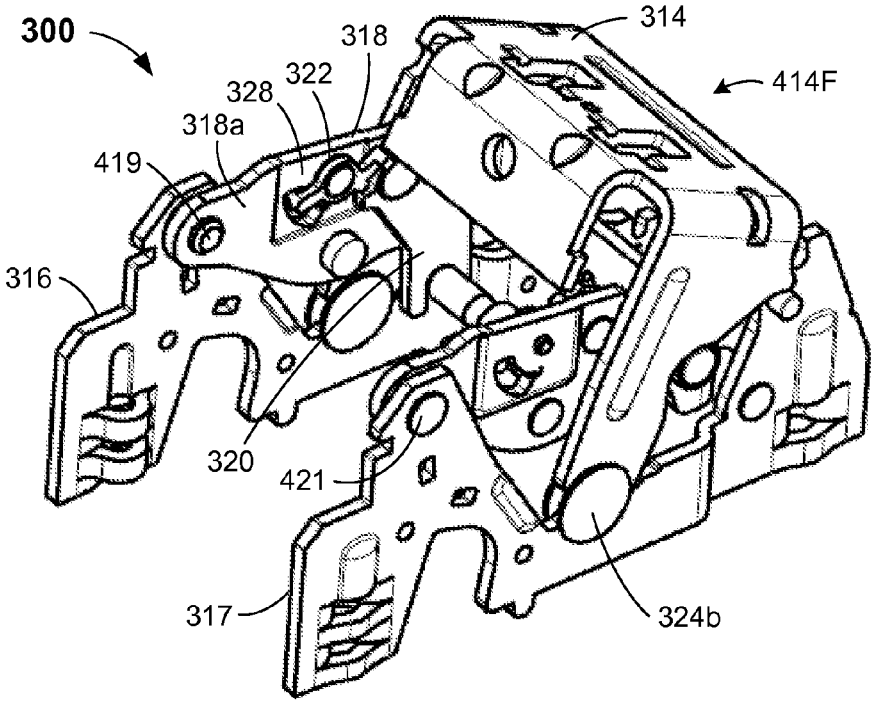
FIGS. 4A and 4B respectively illustrate perspective and side views (with portions not shown for clarity) of the assembly of FIGS. 3A and 3B in an OFF position according to embodiments.
Figure 4B:
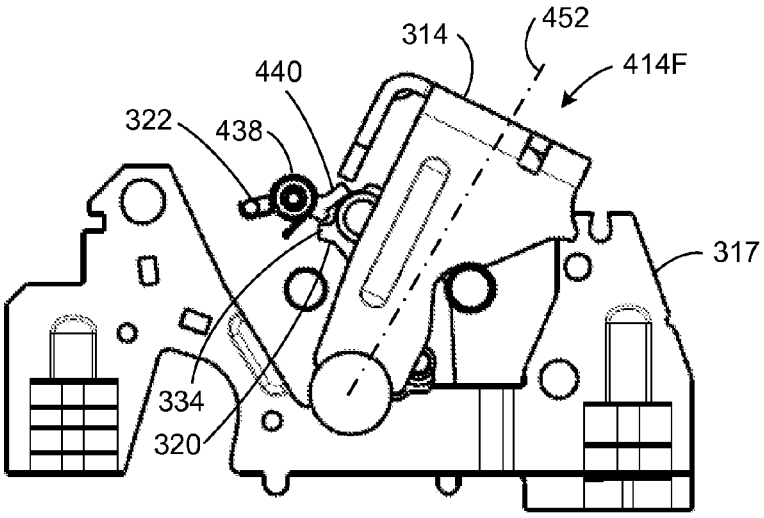
Figure 4C:
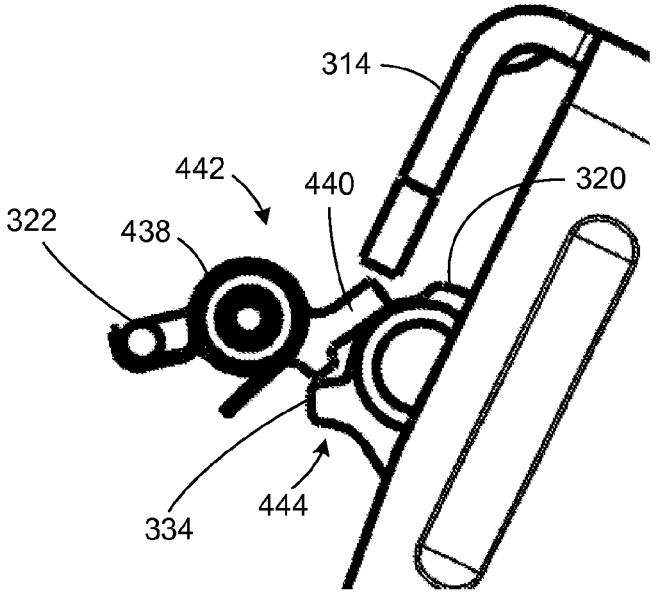
FIG. 4C illustrates a side view of an enlarged portion of the assembly of FIG. 4B according to embodiments.
Figure 5C:
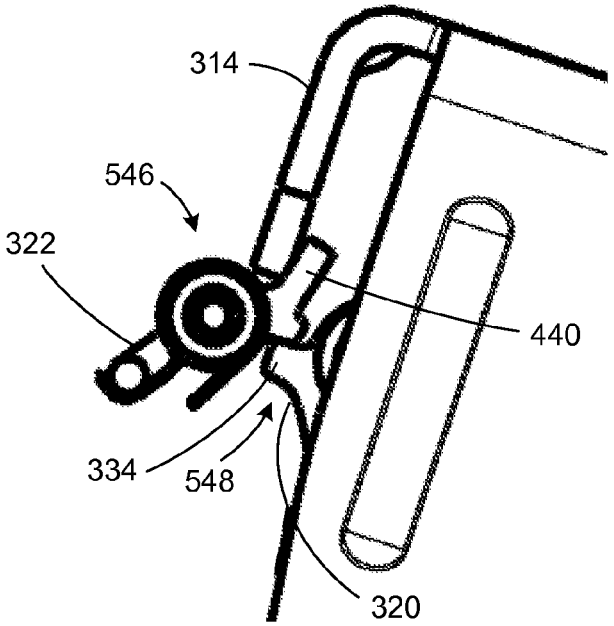
FIG. 5C illustrates a side view of an enlarged portion of the assembly of FIG. 5B according to embodiments.
Figure 5A:
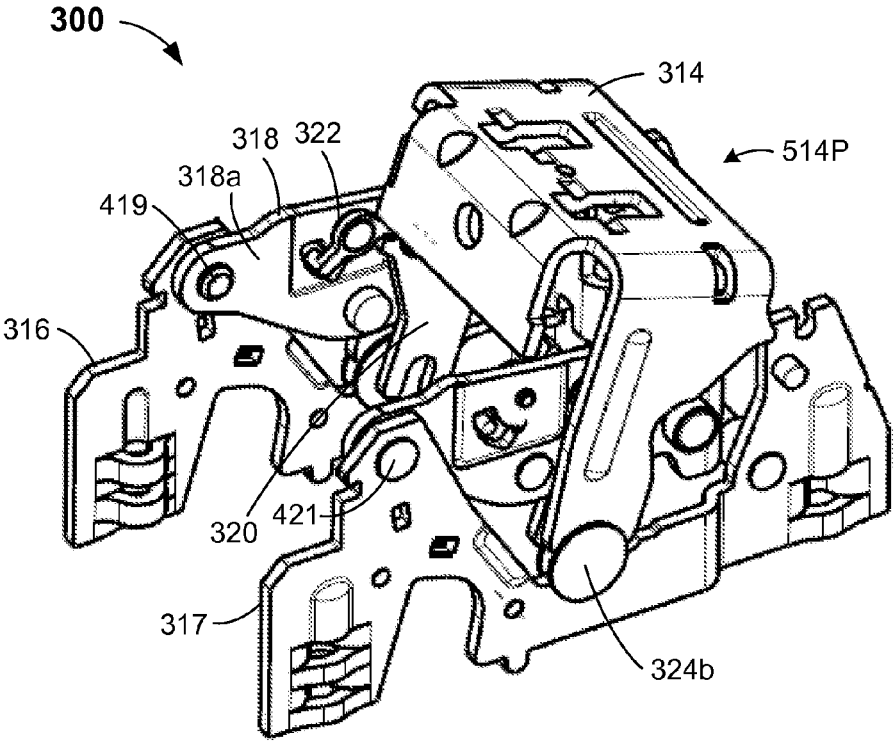
FIGS. 5A and 5B respectively illustrate perspective and side views (with portions not shown for clarity) of the assembly of FIGS. 3A and 3B in a POSITIVE-OFF position according to embodiments.

FIGS. 3A-5C illustrate an assembly 300 of operating components of a circuit breaker having a positive-off stop feature in accordance with one or more embodiments. In particular, FIGS. 3A and 3B show assembly 300 in an ON position 314N, FIGS. 4A-4C show assembly 300 in an OFF position 414F, and FIGS. 5A-5C show assembly 300 in a POSITIVE-OFF position 514P.

Assembly 300 may include an operating lever 314, a first side frame 316, a second side frame 317, a tension lever 318, an upper toggle linkage 320, and a stop link 322. Each of operating lever 314, first side frame 316, second side frame 317, tension lever 318, upper toggle linkage 320, and stop link 322 may be a rigid part made of a metal (e.g., stamped steel) or the like. An operating handle, such as, e.g., operating handle 104 of FIG. 1, may be coupled to operating lever 314 in any suitable manner. Operating lever 314 may be U-shaped in some embodiments. Operating lever 314 may be rotatably coupled to first and second side frames 316 and 317 via respective round bushings 324*a* and 324*b*. That is, operating lever 314 may be configured to rotate about round bushings 324*a* and 324*b*, and operating lever 314 and an operating handle coupled thereto may rotatably move in unison. First side frame 316 and second side frame 317 may be arranged opposite each other and, in some embodiments, may be mirror images of each other. First side frame 316 and second side frame 317 may be coupled to each other via a frame tie (hidden from view) and a latch pin 326 to form a rigid structure that can support various moving components of the circuit breaker. First side frame 316 and second side frame 317 may be mounted or otherwise enclosed in a housing, such as, e.g., housing 102, via one or more mounting features and/or fasteners as is known in the art.

Tension lever 318 may be positioned between side frames 316 and 317 and between the sides of operating lever 314. In some embodiments, tension lever 318 may be U-shaped and may be positioned such that a first side 318*a* extends parallel and adjacent to first side frame 316 and a second side 318*b* extends parallel and adjacent to side frame 317. In some embodiments, tension lever 318 may be rotatably coupled to first side frame 316 via a suitable fastener 419 (see FIG. 4A) and to second side frame 317 via a suitable fastener 421 (see FIG. 4A). Fasteners 419 and 421 may each be, e.g., a rivet, bolt, or the like about which tension lever 318 may rotate. Tension lever 318 may also be held by a latch of a tripping mechanism (neither shown) to stretch main operating springs (also not shown) of the circuit breaker. The main operating springs when stretched provide stored energy for opening the main contacts upon release of tension lever 318 by the latch in response to detection of an overcurrent by the tripping mechanism. In some embodiments, tension lever 318 may have a recessed area 328 on an inside surface of first side 318*a*, and a corresponding recessed area (hidden from view) on an opposite inside surface of second side 318*b*. The recessed areas may each be configured to receive completely therein a respective stop link 322. In some embodiments, the inside surface of second side 318*b* may be configured as a mirror image of the inside surface of first side 318*a*.

Upper toggle linkage 320 may have a first end 320*a* rotatably coupled to tension lever 318 on first side 318*a* via an upper toggle rivet 330. That is, upper toggle linkage 320 may be configured to rotate about upper toggle rivet 330. More particularly, upper toggle linkage 320 may be configured to rotate about upper toggle rivet 330 at first end 320*a* in response to the main contacts of the circuit breaker opening and closing. The forked opposite end of upper toggle linkage 320 may be received on a center toggle pin 332. Center toggle pin 332 may be configured to be coupled to the main operating springs and to a cross bar (neither shown) of the circuit breaker, which may be part of a mechanism that controls the opening and closing of the main contacts. Upper toggle linkage 320 may also be configured to be coupled via center toggle pin 332 to other linkage including, e.g., contact linkage 211 of FIG. 2, for opening and closing the main contacts. Upper toggle linkage 320 may include an extension 334 (better shown in FIGS. 4C and 5C) that may be configured to engage stop link 322 and to cause stop link 322 to rotate in response to rotation of upper toggle linkage 320 about first end 320*a*.

Stop link 322 may be rotatably coupled to tension lever 318 on first side 318*a* via a single spin joint 336. That is, stop link 322 may be configured to rotate about spin joint 336 and may be configured to be rotated by upper toggle linkage 320, as described in more detail below. In some embodiments, stop link 322 may be rotatably coupled to tension lever 318 in recessed area 328, thus advantageously requiring little space within assembly 300. Stop link 322 may be fully received within recessed area 328. A torsion spring 438 (see, e.g., FIGS. 4B and 5B) may be coupled between stop link 322 and first side 318*a* of tension lever 318 to bias the rotation of stop link 322. Stop link 322 may include a flange 440 (see again, e.g., FIGS. 4B and 5B) that may be configured to engage operating lever 314 as operating lever 314 is moved towards OFF position 414F in response to the pair of main contacts of the circuit breaker being stuck to each other, as described in more detail below.

In some embodiments, assembly 300 may include a second upper toggle linkage and/or a second stop link (hidden from view in FIGS. 3A-5C) that may be identically configured as upper toggle linkage 320 and/or stop link 322, respectively. The second upper toggle linkage and/or the second stop link may be coupled to tension lever 318 on inside surface of side 318*b* in an identical or similar manner as upper toggle linkage 320 and/or stop link 322. Alternatively, the second upper toggle linkage and/or the second stop link may be coupled to tension lever 318 in any other suitable fashion. Stop link 322 and the second stop link may be configured to rotate in unison.

FIGS. 3A and 3B show operating lever 314 in ON position 314N (i.e., the main contacts of the circuit breaker are closed, such as, e.g., main contacts 206 and 208 as shown in FIG. 2A). As operating lever 314 is rotatably moved from ON position 314N towards OFF position 414F (FIGS. 4A-4C), upper toggle linkage 320 may be configured to rotate stop link 322 to a first position 442 (see FIG. 4C) provided that the main contacts are not stuck to each other. That is, as the main contacts open as a result of operating lever 314 rotatably moving towards OFF position 414F (i.e., moving from left to right with respect to FIGS. 3A-4B), upper toggle linkage 320 may rotate counterclockwise about first end 320*a* to a first location 444 (see FIG. 4C). As upper toggle linkage 320 rotates to first location 444, stop link 322, which engages and follows extension 334 of upper toggle linkage 320 under the bias of torsion spring 438, may rotate clockwise to first position 442. As shown in FIG. 4C, stop link 322 rotated into position 442 does not engage operating lever 314 as operating lever 314 is rotatably moved towards OFF position 414F, thus allowing operating lever 314 to be rotatably moved fully into OFF position 414F. More particularly, flange 440 of stop link 322 does not engage operating lever 314 as operating lever 314 is rotatably moved.

Figure 5B:
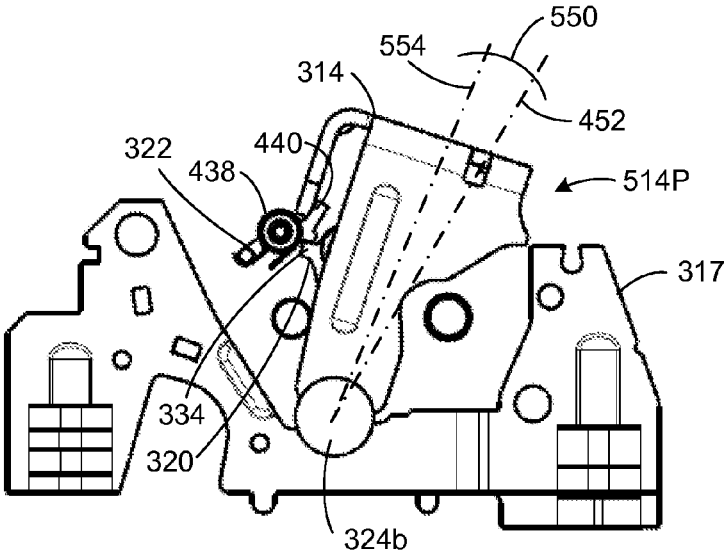

In response to the main contacts of the circuit breaker being welded or otherwise stuck together, upper toggle linkage 320 may be configured to rotate stop link 322 to a second position 546 (see FIG. 5C) as operating lever 314 is rotatably moved from ON position 314N towards OFF position 414F. That is, as the stuck main contacts remain closed while operating lever 314 is rotatably moved towards OFF position 414F, upper toggle linkage 320 may rotate counterclockwise about first end 320*a* to a second location 548 (see FIG. 5C). As shown in FIGS. 4C and 5C, upper toggle linkage 320 may not rotate as far when rotating to second location 548 as when rotating to first location 444. As upper toggle linkage 320 rotates to second location 548, stop link 322, which engages and follows extension 334 of upper toggle linkage 320 under the bias of torsion spring 438, may rotate clockwise to second position 546. As shown in FIG. 5C, stop link 322 rotated into position 546 may be configured to engage operating lever 314 as operating lever 314 is rotatably moved towards OFF position 414F. More particularly, flange 440 of stop link 322 may be configured to engage operating lever 314 as operating lever 314 is rotatably moved towards OFF position 414F. Stop link 322 in second position 546 may also be configured to prevent operating lever 314 from moving into OFF position 414F upon engagement with operating lever 314. In some embodiments, stop link 322 in second position 546 may be configured to engage and stop operating lever 314 from moving towards OFF position 414F when operating lever 314 is angularly about 7 to 10 degrees away from OFF position 414F, as illustrated in FIG. 5B. An angle 550, which may be measured between a center line 452 (shown in FIGS. 4B and 5B) of operating lever 314 in OFF position 414F and a center line 554 (shown in FIG. 5B) of operating lever 314 in POSITIVE-OFF position 514P, may be about 7 to 10 degrees. In other embodiments, angle 550 may have other suitable values.

Figure 6:
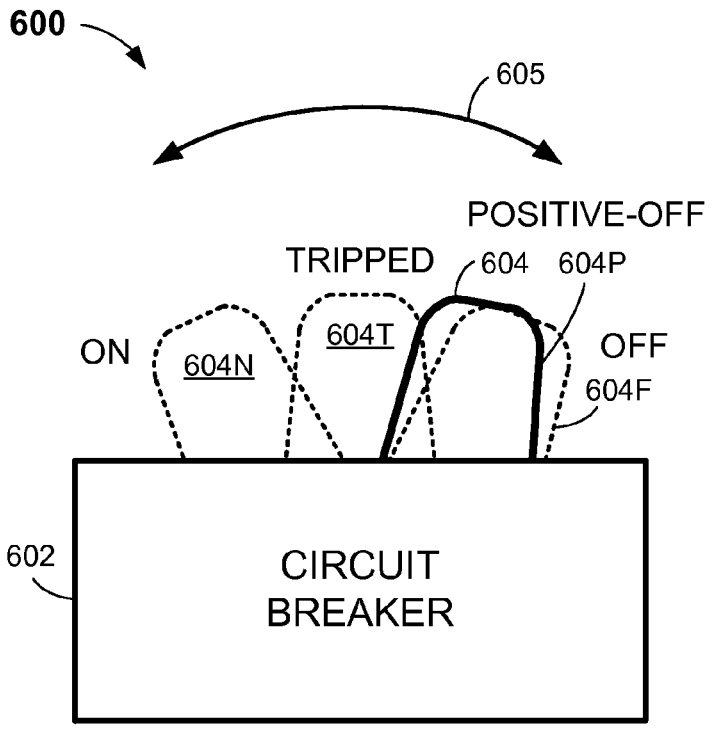
FIG. 6 illustrates a block diagram of a circuit breaker and its operating handle positions according to embodiments.
Figure 6A:
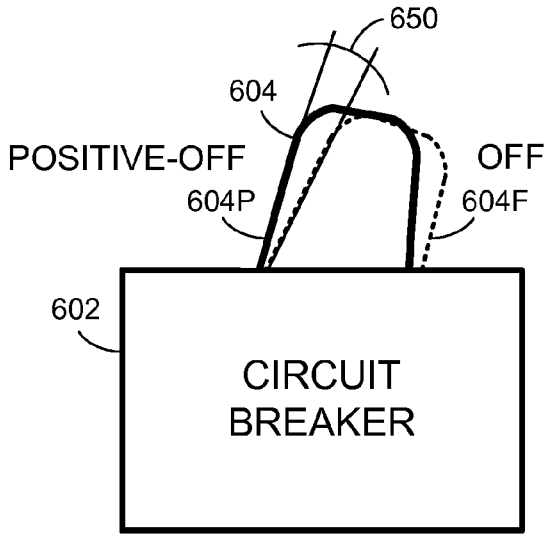
FIG. 6A illustrates a block diagram of a portion of the circuit breaker of FIG. 6 and its POSITIVE-OFF and OFF operating handle positions according to embodiments.

FIG. 6 illustrates a circuit breaker 600 and four operating handle positions thereof in accordance with one or more embodiments. Circuit breaker 600 may include a housing 602, which may be similar or identical to housing 102 of FIG. 1. Circuit breaker 600 may also include an operating handle 604 mounted on housing 602 that may be configured to move rotatably as shown via double-headed arrow 605. Circuit breaker 600 may include within housing 602 a pair of main contacts and corresponding contact arms and linkage, such as, e.g., main contacts 206 and 208, movable contact arm 210, contact linkage 211, and stationary contact arm 212 of FIG. 2. Circuit breaker 600 may further include assembly 300 of FIGS. 3A-5C mounted within housing 602. Operating handle 604 may be coupled to operating lever 314 in any suitable manner and may be moved manually into an ON position 604N (shown in phantom) and automatically into a TRIPPED position 604T (also shown in phantom) as described above in connection with FIGS. 1, 2A, and 2B. Operating handle 604 may also be moved manually into an OFF position 604F (shown in phantom) provided that the main contacts of circuit breaker 600 are not stuck to each other. Operating handle 604 may further be moved manually into a POSITIVE-OFF position 604P, as shown in FIG. 6, as result of the positive-off stop feature in accordance with one or more embodiments. POSITIVE-OFF position 604P may correspond to POSITIVE-OFF position 514P of FIGS. 5A and 5B. As shown in FIG. 6A, POSITIVE-OFF position 604P may be angularly located prior to OFF position 604F by an angle 650. In some embodiments, angle 650 may range from about 7 to 10 degrees. This 7 to 10 degree range may be sufficient to prevent an operating handle from being padlocked in the OFF position. In other embodiments, POSITIVE-OFF position 604P may be angularly located prior to OFF position 604F by other suitable angles 650.

Figure 7:
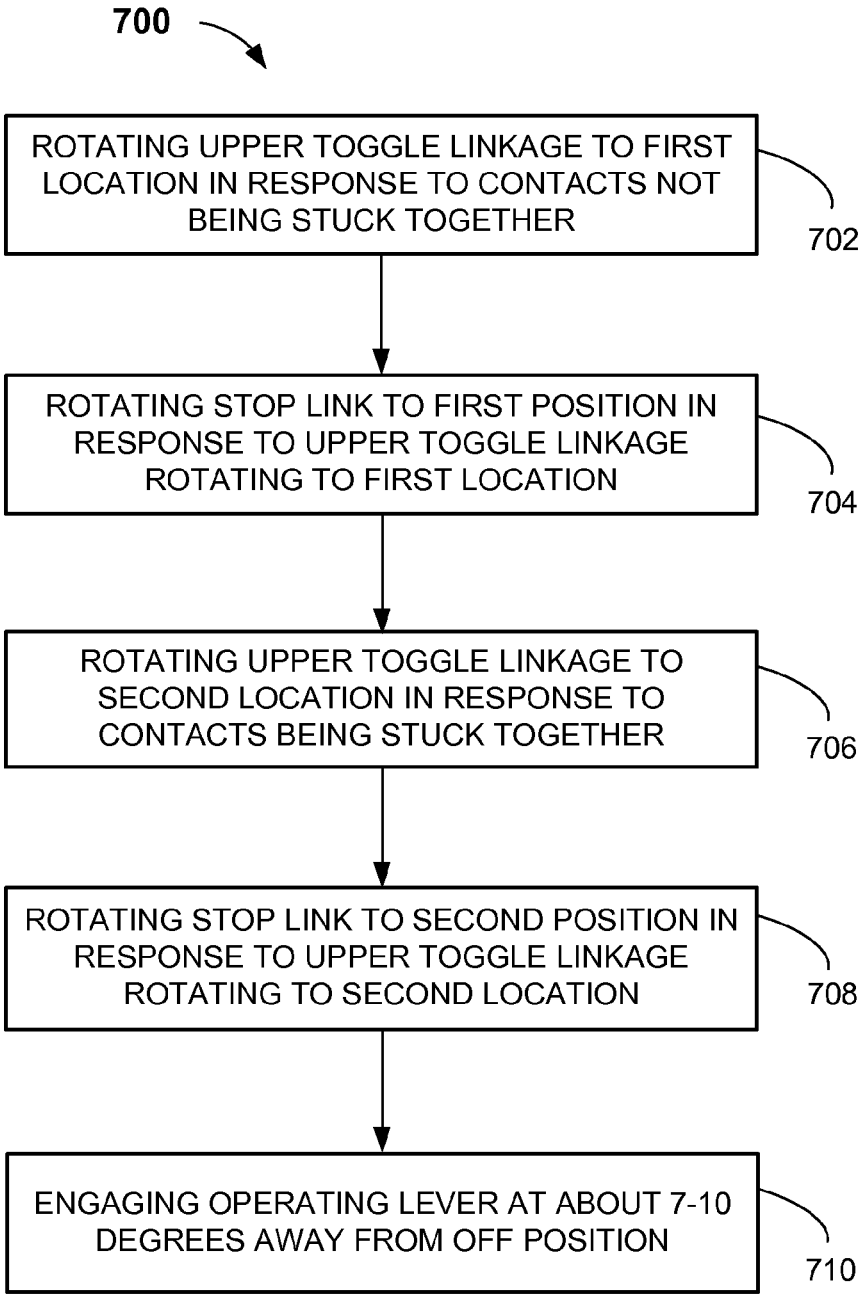
FIG. 7 illustrates a flowchart of a method of preventing a circuit breaker from being set in an OFF position in response to a pair of main contacts of the circuit breaker being stuck together according to embodiments.

FIG. 7 illustrates a flowchart of a method 700 of preventing a circuit breaker from being set in an OFF position in response to a pair of main contacts of the circuit breaker being stuck together in accordance with one or more embodiments. The circuit breaker may include an upper toggle linkage (e.g., upper toggle linkage 320), a tension lever (e.g., tension lever 318), a stop link (e.g., stop link 322), and an operating lever (e.g., operating lever 314). Method 700 may include at process block 702 rotating the upper toggle linkage about a first end of the upper toggle linkage to a first location in response to the main contacts not being stuck together, the upper toggle linkage rotatably coupled to the tension lever. For example, as shown in FIG. 4C, upper toggle linkage 320 may be rotated to first location 444 in response to the main contacts not being stuck together.

At process block 704, method 700 may include rotating the stop link (e.g., stop link 322) rotatably coupled to the tension lever to a first position (e.g., first position 442 of FIG. 4C) in response to the upper toggle linkage rotating to the first location.

At process block 706, method 700 may include rotating the upper toggle linkage about the first end to a second location in response to the pair of main contacts being stuck together. For example, referring to FIGS. 5A-5C, upper toggle linkage 320 may be rotated to second location 548 in response to the pair of main contacts (e.g., main contacts 206 and 208 of FIG. 2A) being stuck together.

At process block 708, method 700 may include rotating the stop link rotatably to a second position in response to the upper toggle linkage rotating to the second location. For example, again referring to FIGS. 5A-5C, stop link 322 may be rotated to second position 546 in response to upper toggle linkage 320 rotating to second location 548.

Method 700 may further include at process block 710, engaging the operating lever at about 7 to 10 degrees away from the OFF position as the operating lever is being moved towards the OFF position in response to the stop link rotating to the second position. The engaging may be performed by, e.g., flange 440 of stop link 322, as best shown in FIGS. 5B and 5C. In some embodiments, the engaging of the operating lever may include preventing the operating lever from moving closer to the OFF position than about 7 to 10 degrees away from the OFF position, as best shown in FIGS. 5B and 6A, wherein angles 550 and 650 representing the angular distance between POSITIVE-OFF positions 514P and 604P, respectively, and OFF positions 414F and 604F, respectively, may range from about 7 to 10 degrees.

The above process blocks of method 700 may be executed or performed in an order or sequence not limited to the order and sequence shown and described. For example, in some embodiments, process blocks 706, 708, and 710 may be performed before process blocks 702 and 704. In some embodiments, process blocks 702 and 704 may be performed simultaneously, and/or process blocks 706 and 708 may be performed simultaneously.

Figure 8:
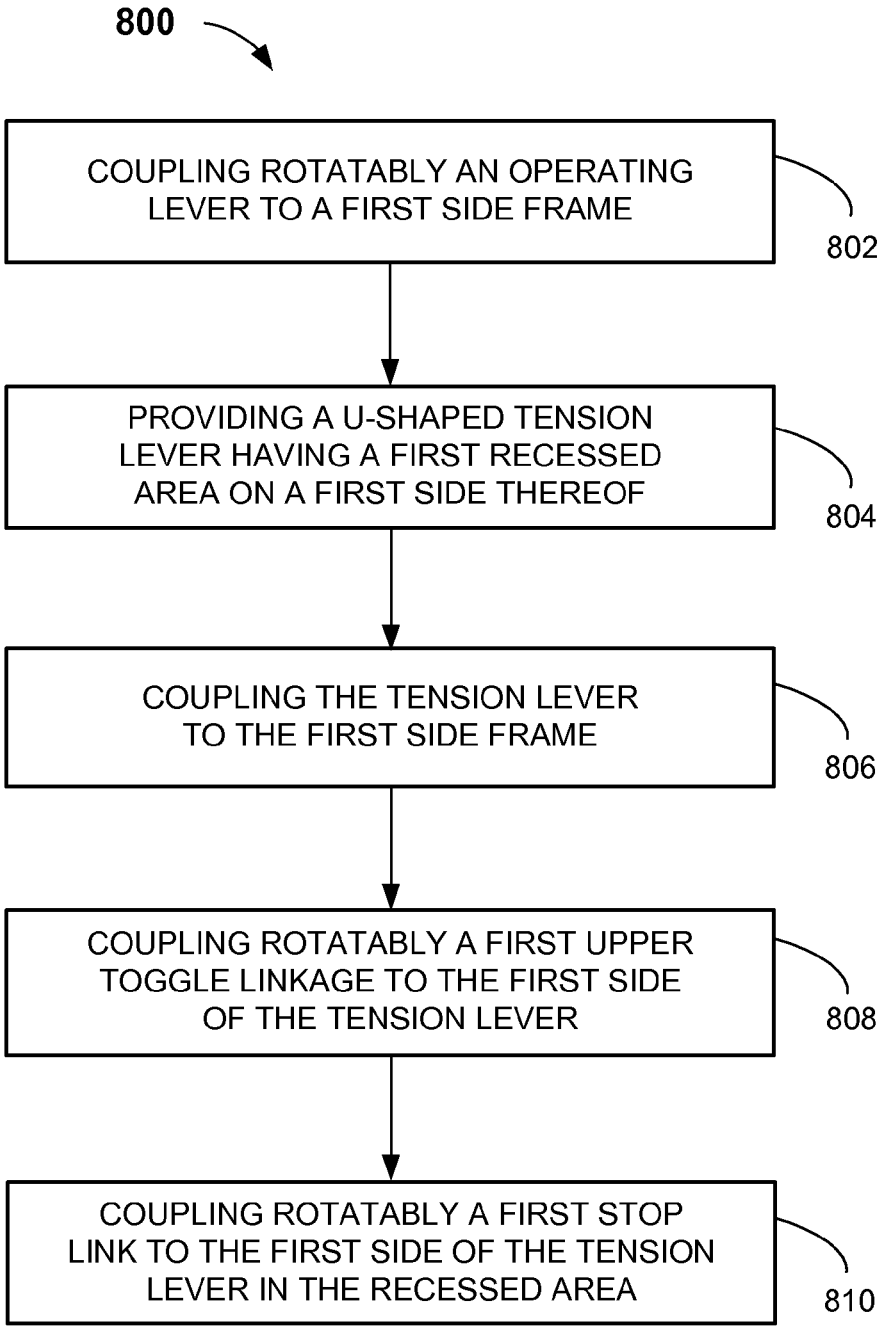
FIG. 8 illustrates a flowchart of a method of assembling a circuit breaker positive-off stop feature according to embodiments.

FIG. 8 illustrates a flowchart of a method 800 of assembling a circuit breaker positive-off stop feature in accordance with one or more embodiments. Method 800 may include at process block 802 coupling rotatably an operating lever to a first side frame. For example, as shown in connection with FIG. 3A, operating lever 314 may be rotatably coupled side frame 316 via round bushing 324*a*.

At process block 804, method 800 may include providing a U-shaped tension lever (e.g., tension lever 318) having a first recessed area (e.g., recessed area 328) on a first side (e.g., first side 318*a*) of the tension lever. The U-shaped tension lever may be a rigid part made of a metal (e.g., stamped steel) or the like.

At process block 806, method 800 may include coupling the tension lever (e.g., tension lever 318) to the first side frame (e.g., side frame 316). For example, as shown in FIG. 4A, e.g., tension lever 318 may be coupled to first side frame 316 via fastener 419.

At process block 808, method 800 may include coupling rotatably a first end of a first upper toggle linkage to the first side of the tension lever. For example, referring to FIGS. 3A-5C, first end 320*a* of upper toggle linkage 320 may be rotatably coupled to first side 318*a* of tension lever 318 via, in some embodiments, an upper toggle rivet 330.

Method 800 may further include at process block 810, coupling rotatably a first stop link (e.g., stop link 322) to a first side (e.g., first side 318*a*) of the tension lever (e.g., tension lever 318) in the first recessed area (e.g., recessed area 328). In some embodiments, the first stop link may be configured to be rotated by the first upper toggle linkage into a first position that does not engage the operating lever as the operating lever moves rotatably to and from an ON position and an OFF position. The first stop link may also be configured to be rotated by the first upper toggle linkage into a second position that stops the operating lever from moving rotatably into the OFF position at about 7 to 10 degrees away from the OFF position.

The above process blocks of method 800 may be executed or performed in an order or sequence not limited to the order and sequence shown and described. For example, in some embodiments, process block 802 may be performed after or in parallel with process block 804. Similarly, process blocks 808 and 810 may be performed in reverse order.

In some embodiments, method 800 may further include coupling rotatably the operating lever (e.g., operating lever 314) to a second side frame (e.g., second side frame 317), providing the U-shaped tension lever having a second recessed area on a second side (e.g., second side 318*b*) of the tension lever, coupling rotatably a first end of a second upper toggle linkage to the second side of the tension lever; and coupling rotatably a second stop link to the second side of the tension lever in the second recessed area. In some embodiments, the second stop link may be configured to be rotated by the second upper toggle linkage into a third position that does not engage the operating lever as the operating lever moves rotatably to and from the ON position and the OFF position. The second stop link may also be configured to be rotated by the second upper toggle linkage into a fourth position that stops the operating lever at about 7 to 10 degrees away from the OFF position from moving rotatably into the OFF position. In some embodiments, the first stop link and the second stop link rotate in unison.

Persons skilled in the art should readily appreciate that the invention described herein is susceptible of broad utility and application. Many embodiments and adaptations of the invention other than those described herein, as well as many variations, modifications, and equivalent arrangements, will be apparent from or reasonably suggested by the invention and the foregoing description thereof, without departing from the substance or scope of the invention. For example, although described in connection with circuit breakers, the apparatus and methods described herein may have application in other devices wherein movement of a rotatable part should be restricted under certain conditions. Accordingly, while the invention has been described herein in detail in relation to specific embodiments, it should be understood that this disclosure is only illustrative and presents examples of the invention and is made merely for purposes of providing a full and enabling disclosure of the invention. This disclosure is not intended to limit the invention to the particular apparatus, devices, assemblies, systems, or methods disclosed, but, to the contrary, the intention is to cover all modifications, equivalents, and alternatives falling within the scope of the invention, as defined by the following claims.

What is claimed is:

1. A circuit breaker, comprising:

a side frame;

an operating lever rotatably mounted to the side frame and configured to move rotatably to and from an ON position and an OFF position provided a pair of main contacts of the circuit breaker is not stuck together;

a tension lever coupled to the side frame;

an upper toggle linkage having a first end rotatably coupled to the tension lever; and a stop link rotatably coupled to the tension lever and configured to be rotated by the upper toggle linkage; wherein:

the upper toggle linkage is configured to rotate the stop link to a first position provided that the main contacts are not stuck to each other and is configured to rotate the stop link to a second position in response to the main contacts being stuck to each other, the stop link in the second position configured to engage the operating lever as the operating lever is moved rotatably towards the OFF position.

2. The circuit breaker of claim 1, wherein the stop link in the second position is configured to prevent the operating lever from moving into the OFF position.

3. The circuit breaker of claim 1, wherein the stop link in the second position is configured to engage and stop the operating lever from moving towards the OFF position when the operating lever is about 7 to 10 degrees away from the OFF position.

4. The circuit breaker of claim 1, wherein the stop link in the first position does not engage the operating lever as the operating lever rotatably moves to and from the ON and the OFF positions.

5. The circuit breaker of claim 1, wherein the tension lever is U-shaped and the upper toggle linkage and the stop link are rotatably coupled to a same side of the tension lever.

6. The circuit breaker of claim 1, wherein the tension lever has a side having a recessed area, and the stop link is rotatably coupled to the tension lever in the recessed area.

7. The circuit breaker of claim 1, wherein the upper toggle linkage is configured to rotate about the first end in response to the main contacts opening and closing.

8. The circuit breaker of claim 1, wherein upper toggle linkage has an extension that engages the stop link and causes the stop link to rotate in response to rotation of the upper toggle linkage about the first end.

9. The circuit breaker of claim 1, wherein the stop link has a flange that engages the operating lever as the operating lever is being moved towards the OFF position in response to the pair of main contacts being stuck to each other.

10. The circuit breaker of claim 1, wherein the upper toggle linkage is configured to rotate in a first rotational direction to rotate the stop link in a second opposite rotational direction.

11. The circuit breaker of claim 1, further comprising an operating handle coupled to the operating lever.

12. A method of preventing a circuit breaker from being set in an OFF position in response to a pair of main contacts of the circuit breaker being stuck together, the circuit breaker comprising an upper toggle linkage, a tension lever, a stop link, and an operating lever, the method comprising:

rotating the upper toggle linkage about a first end of the upper toggle linkage to a first location in response to the pair of main contacts not being stuck together, the upper toggle linkage rotatably coupled to the tension lever;

rotating the stop link rotatably coupled to the tension lever to a first position in response to the upper toggle linkage rotating to the first location;

rotating the upper toggle linkage about the first end to a second location in response to the pair of main contacts being stuck together;

rotating the stop link rotatably to a second position in response to the upper toggle linkage rotating to the second location; and engaging the operating lever at about 7 to 10 degrees away from the OFF position as the operating lever is being moved towards the OFF position in response to the stop link rotating to the second position.

13. The method of claim 12, wherein the upper toggle linkage causes the rotating of the stop link to the first position and to the second position.

14. The method of claim 12, wherein the engaging the operating lever comprises preventing the operating lever from moving closer to the OFF position than about 7 to 10 degrees away from the OFF position.

15. The method of claim 12, further comprising coupling the stop link to the tension lever in a recessed area of the tension lever.

16. The method of claim 12, wherein the tension lever is U-shaped and the method further comprises coupling the upper toggle linkage and the stop link to a same side of the tension lever.

17. A method of assembling a circuit breaker positive-off stop feature, the method comprising:

coupling rotatably an operating lever to a first side frame;

providing a U-shaped tension lever having a first recessed area on a first side of the tension lever;

coupling the tension lever to the first side frame;

coupling rotatably a first end of a first upper toggle linkage to the first side of the tension lever; and coupling rotatably a first stop link to the first side of the tension lever in the first recessed area; wherein:

the first stop link is configured to be rotated by the first upper toggle linkage into a first position that does not engage the operating lever as the operating lever moves rotatably to and from an ON position and an OFF position; and the first stop link is configured to be rotated by the first upper toggle linkage into a second position that stops the operating lever from moving rotatably into the OFF position at about 7 to 10 degrees away from the OFF position.

18. The method of claim 17, further comprising:

coupling rotatably the operating lever to a second side frame;

providing the U-shaped tension lever having a second recessed area on a second side of the tension lever;

coupling rotatably a first end of a second upper toggle linkage to the second side of the tension lever; and coupling rotatably a second stop link to the second side of the tension lever in the second recessed area; wherein:

the second stop link is configured to be rotated by the second upper toggle linkage into a third position that does not engage the operating lever as the operating lever moves rotatably to and from the ON position and the OFF position; and the second stop link is configured to be rotated by the second upper toggle linkage into a fourth position that stops the operating lever at about 7 to 10 degrees away from the OFF position from moving rotatably into the OFF position.

19. The method of claim 18, wherein the first stop link and the second stop link rotate in unison.

20. The method of claim 17 further comprising:

providing the first stop link with a flange configured to engage the operating lever in response to the first stop link being at the second position; and providing the first upper toggle linkage with an extension configured to engage and cause to rotate the first stop link.

* * * * *